United States Patent [19]

Budzyna

[11] 4,249,580

[45] Feb. 10, 1981

[54] WEFT CONTROL DEVICE

[75] Inventor: Edward S. Budzyna, Tallahasse, Fla.

[73] Assignee: Rockwell International Corporation, Pittsburgh, Pa.

[21] Appl. No.: 77,203

[22] Filed: Sep. 20, 1979

[51] Int. Cl.[3] ..... D03D 47/34

[52] U.S. Cl. ..... 139/450; 139/429; 139/452; 112/254; 242/149; 66/146

[58] Field of Search ..... 139/429, 446, 450, 452; 112/254, 278; 242/147, 149; 66/146

[56] References Cited

U.S. PATENT DOCUMENTS

| | | | |
|---|---|---|---|
| 418,242 | 12/1889 | Slentz | 242/149 |
| 657,351 | 9/1900 | Miller | 242/149 |
| 1,672,471 | 6/1928 | Peterson | 242/149 |
| 3,280,853 | 10/1966 | Brown et al. | 139/452 |

FOREIGN PATENT DOCUMENTS

| | | | |
|---|---|---|---|
| 7511117 | 3/1977 | Netherlands | 139/450 |

*Primary Examiner*—Henry Jaudon

[57] ABSTRACT

An improved weft control device for shuttleless looms in which weft is drawn between a pair of friction plates mounted on individual post elements in a manner whereby their free ends are disposed in contiguous relation. The device provides a control lever fixed to the lower end of each post element which are operatively connected one to the other. One of the control levers is of greater length than the other and defines an indicating arm that is disposed in operative association with a band of indicating indicia provided on a support member for the post elements. By manually moving the indicating arm in one direction or the other to a preselected graduation of the indicating indicia, the post elements will rotate simultaneously and in opposite directions and the force with which one friction plate engages the other can be increased or decreased as desired.

3 Claims, 5 Drawing Figures

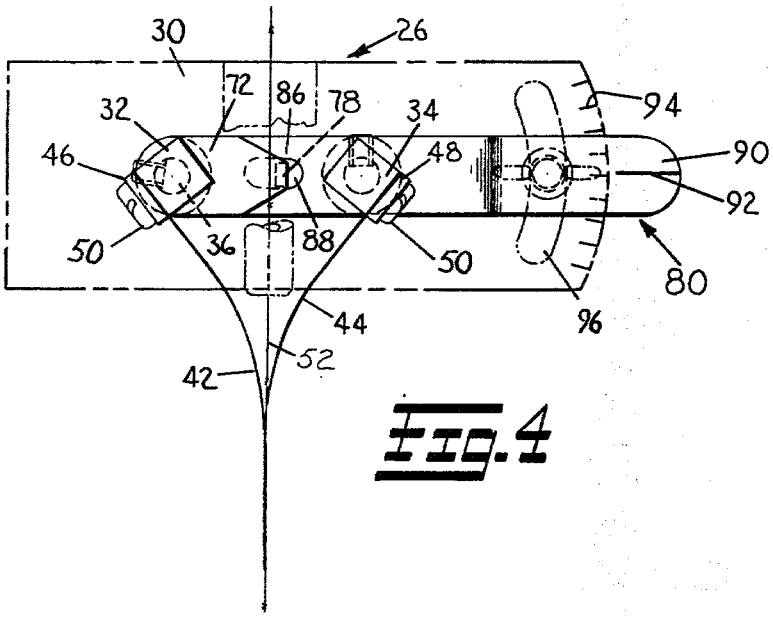
Fig. 4
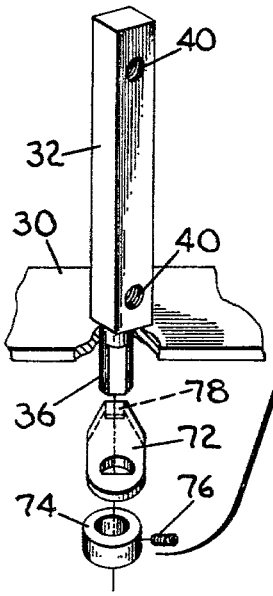
Fig. 5
Fig. 1
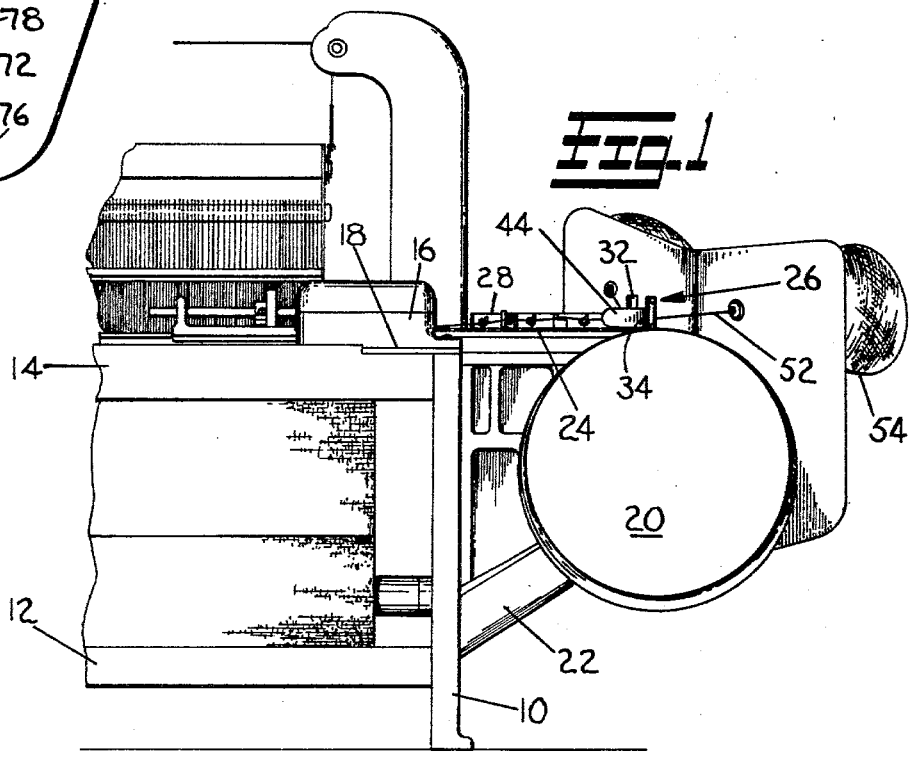

WEFT CONTROL DEVICE

BACKGROUND OF THE INVENTION

1. Field of the Invention

The invention relates to shuttleless looms wherein weft yarn is drawn from a stationary source and is inserted into sheds of warp threads by opposed carrier members that are attached to the free end of flexible tapes which are alternately wrapped about and extended from oscillating tape wheels located at each side of the loom. The timed sequence with the weaving cycle the weft yarn is acted upon by a presenting member which locates the weft in a position for reception by a so-called inserting carrier which carries said weft into the shed and presents it to a so-called extending carrier the draws the weft through the remainder of the shed to complete a single pick.

In particular the invention pertains to an improved weft yarn tensioning device of the friction plate type whereby the resistance the plates apply to the weft yarn being drawn therebetween can be quickly and easily varied to meet the tensioning requirements of any particular count of weft.

2. Description of the Prior Art

Shuttleless looms to which the present invention is applicable can be of the type in which weft is supplied from one or more sources or which may employ either the Gabler or Dewas system of weft insertion. In such looms, a weft presenting member is actuated in timed sequence with the weaving cycle so as to locate said weft in a position where it will be received into and taken by the inserting carrier into a shed for presentation to the weft extending carrier.

Weft yarn tensioning devices of the spring biased friction plate type are well known to those conversant in the weaving art, and for a detailed showing and description of this type of device, attention is directed to U.S. Pat Nos. 3,280,853 and 3,561,498.

Although these weft yarn tensioning devices have satisfactorily performed their intended function for many years, they have been considered quite troublesome when attempting to establish a uniform tension on a plurality of looms using the same type of weft. Additionally, it has been considered particularly troublesome and time consuming when attempting to reposition the friction plates so as to vary the tension being applied to the weft passing therebetween or to re-locate said friction plates to satisfactorily accommodate a change in weft yarn to one of a different count.

The problems described above of establishing uniform weft tension on several looms and of selectively varying the tension being applied to the weft yarn can be attributed to the fact that the friction plates are carried by post elements individual thereto that are independently mounted in spaced relation on a common support bracket. To reposition the friction plates so that they engage one another with greater or less biasing force requires independent adjustment of each of the post elements. The post elements must first be loosened and than slightly rotated in one direction or the other, depending on the amount of biasing force desired, and then retightened. It is quite obvious that with this means of varying and controlling the tension of weft yarn it would be very difficult to obtain a uniform tension on a plurality of looms utilizing the same weft and necessitates an excessive amount of loom down time to vary and obtain the most desirable amount of tension for a particular count of weft. The weft control device of the present invention has overcome the problems described above by providing a control means for said device which enables the post elements for each friction plate to be simultaneously rotated to anyone of a plurality of pre-determined positions which is effective in a minimum amount of time of increasing or decreasing the amount of biasing force produced by said friction plates as desired.

SUMMARY OF THE INVENTION

The weft control device according to the invention is of the spring biased friction plate type in which said plates are carried on separate post elements individual thereto that are mounted on a common support bracket. A control lever is attached to the lower end of each post element and they are operatively connected one to the other. One of the control levers is of greater length and its outer end defines an indicating arm that is disposed in operative association with an arcuated band of indicating indicia on the forward end of the support bracket. By selectively moving the indicating arm to any desired position along the length of the band of indicating indicia, the post elements by means of their respective control levers are caused to rotate simultaneously and in opposite directions and are effective, depending on the direction of movement of said indicating arm, in increasing or decreasing the biasing force of the friction plates as desired. A locking means associated with the indicating arm provides a means for fixing the position of the latter in a selected position and for maintaining the friction plates in the position effected by the rotative movement of the post elements. It is a general object of the invention to provide a weft tension control device for shuttleless looms which can be quickly and easily regulated to obtain the desired amount of tension to which the weft yarn is to be subjected.

A further object is to provide a weft tension control device for a shuttleless loom wherein the desired amount of tension on the weft yarn can be selectively obtained and the same selections made on a plurality of such looms utilizing the same type of weft yarn.

Another object is to provide an improved weft control device of simplified construction, having a minimum number of parts which are relatively inexpensive to manufacture and with long life expectancy.

These and other objects of the invention will become more fully apparent by reference to the appended claims and as the following detailed description proceeds in reference to the figures of drawing wherein:

BRIEF DESCRIPTION OF THE DRAWINGS

FIG. 1 is a view in front elevation of a portion of a shuttleless loom showing the device according to the invention applied thereto;

FIG. 4 is a top view of a portion of the device in FIG. 2 with certain parts omitted to more clearly show the relationship of the control levers; and FIG. 5 is a perspective view in exploded form showing one of the post elements and the means by which its control lever is assembled thereto.

DESCRIPTION OF THE PREFERRED EMBODIMENT

Figure 2:
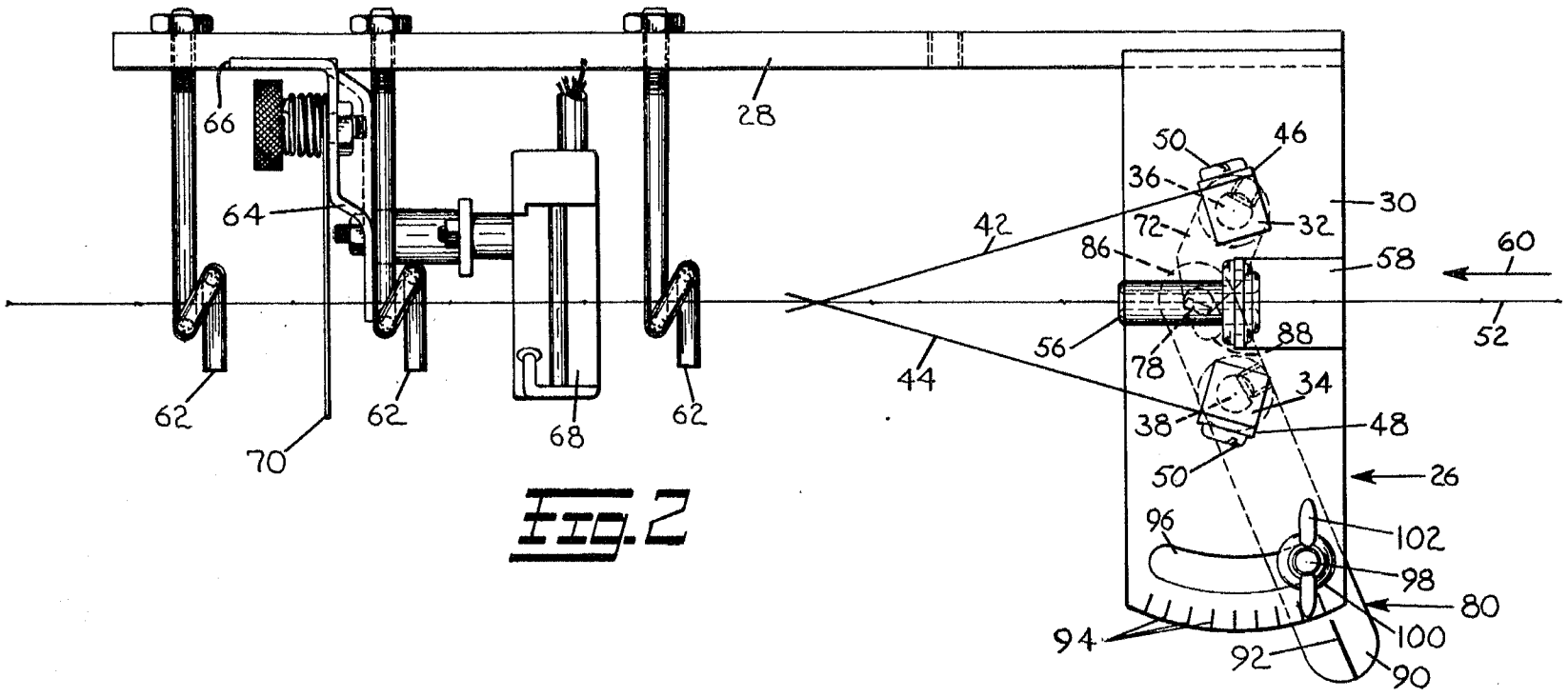
FIG. 2 is a top view and of an enlarged scale of the device according to the invention shown in FIG. 1.

Now referring to the figures of drawing enough of a shuttleless loom is shown in FIG. 1 to serve as a basis for a detailed description of the invention applied thereto.

In FIG. 1 the forward right hand end of a shuttleless loom is shown and among the various parts thereof there is shown portions of the framework which include the right hand loomside 10, front girt 12 and breast beam 14.

The well known weft control housing identified by numeral 16 is mounted in a conventional manner on the forward and upper surface of the loom as at 18. The loom's right hand tape wheel housing is shown at 20 and is carried by a conventional support bracket 22 that is attached to the outer side of the loomside 10. The usual tape guide operatively associated with the tape wheel housing 20 is identified by numeral 24.

The weft control device according to the invention is identified generally in FIGS. 1-4 by numeral 26 and includes a mounting plate 28 that attaches to the loom by any suitable means not shown. As shown in FIG. 2 one end of this mounting plate 28 has a laterally extending support plate 30 fixed thereon which serves to support the various elements comprising the invention now to be described.

The support plate 30 has a pair of vertically extending post elements mounted in spaced relation thereon, with the portions extending upwardly from said support plate having a generally square cross-sectional confirugation, that are identified by numerals 32 and 34 respectively. The lower portion of each post element 32 and 34 define axially aligned gudgeons 36 and 38 respectively which extend through and below mounting holes (not shown) provided in said support plate 30. These gudgeons 36 and 38 have cooperating control levers assembled thereon and will be more fully described hereinafter.

As shown in FIG. 5, each of the post elements is provided with a pair of tapped holes 40 which are disposed in spaced and aligned relation. These tapped holes 40 serve as a means of attaching a spring biased friction plate to each post element 32 and 34 that are identified by numerals 42 and 44 respectively by means of anchor plates 46 and 48 respectively. The anchor plates are provided with openings (not shown) which are aligned with the topped holes 40 in the post elements and by means of screws 50 the anchor plates 46 and 48 are fixed to the post elements individual thereto in a manner whereby one end of the associated spring biased friction plate is firmly held therebetween.

As shown in FIGS. 2 and 4, the post elements 32 and 34 are angularly disposed so that the free ends of the spring biased friction plates mounted thereon will be in contact with one another and engage a weft yarn 52 being drawn therebetween.

The weft yarn is drawn from a source 54 (FIG. 1) and maintained in a pathway located centrally of the post elements 32 and 34 by being caused to pass through a flanged guide bushing 56 mounted on an L-shaped bracket 58 which is fixed by any suitable means not shown to the upper surface of the support plate 30.

The weft yarn is drawn between the spring biased friction plates in the direction of the indicating arrow 60 (FIGS. 2 and 3) and after leaving said plates it passes through a plurality of conventional guide eyelets 62 that are mounted in spaced and aligned relation on the mounting plate 28. This mounting plate also has a support bracket 64 fixed thereon as at 66 in FIG. 2 and serves to support a well known weft sensing device 68 between one pair of guide eyelets 62 and a spring loaded draw back arm 70 between the adjacent guide eyelets 62. As is well known, the draw back arm 70 serves to prevent any possible slack in the weft yarn 52.

Referring now to FIG. 5, the gudgeon 36 forming the lower end of the post element 32 has a control lever 72 fixed thereon by means of a collar 74 having a locking set screw 76. The end of this control lever 72 most remote from the gudgeon 36 is provided with an integrally formed depending tooth 78 which serves as a means for selectively rotating the post element 32 in a manner yet to be described.

Figure 3:
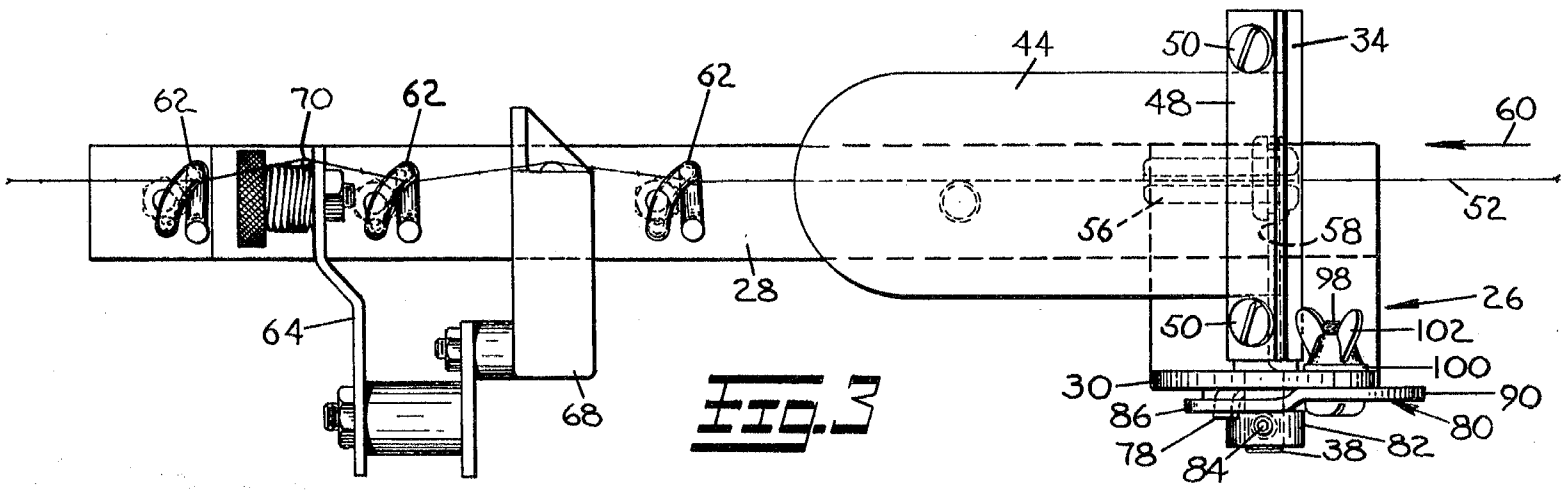
FIG. 3 is a view in side elevation of the device in FIG. 2.

The gudgeon 38 forming the lower end of the post element 34 has a control lever generally indicated by numberal 80 which intermediate its ends is fixed thereon by means of a collar 82 having a locking set screw 84 (FIG. 3). This control lever 80 has one end 86 thereof that is provided with an elongated opening 88 within which the depending tooth 78 of the control lever 72 is disposed thereby operatively connecting one control lever to the other.

The opposite end of the control lever 80 defines an indicating arm that is depicted by numeral 90 and is of greater length than end 86. This indicating arm protrudes beyond the end of the support plate 30 (FIGS. 2 and 4) and is provided thereon with an indicator 92 that is disposed in operative association with an arcuated band of indicating indicia 94 formed on the end of said support plate 30.

Immediately adjacent to the band of indicating indicia 94, the support plate 30 is provided with an arcuated slot 96. In alignment with the arcuated slot 96, the indicating arm 90 has a bolt 98 assembled therein with its threaded portion extending upwardly through said arcuated slot and provides a means whereby said indicating arm can be selectively moved within the limits thereof. A washer 100 and wing nut 102 assembled on the threaded portion of the bolt 98 provide a means whereby the indicating arm 90 can be locked in any desired position within the limits of the arcuated slot 96.

Movement of the indicating arm in one direction or the other to align the indicator 92 with a desired graduation on the band of indicating indicia 94 will cause the post elements 32 and 34 to turn in opposite directions and the biasing force which the friction plates, provide one against the other can be decreased or increased as shown in FIGS. 2 and 4 respectively. It is obvious from the detailed description that the amount of tension to which weft yarn is subjected can be quickly and easily varied as desired and a uniform tension is easily obtainable on a plurality of looms utilizing the same kind and count of weft yarn.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A weft control device for looms of the shuttleless type wherein weft drawn from a stationary source is presented to an inserting member and inserted into sheds of warp threads, said device comprising:

(a) a support means fixed on the loom intermediate the weft source and warp threads;

(b) a pair of spaced post elements mounted on said support means including:

(i) a spring biased friction plate attached to each of said post elements and disposed for engagement one with the other for applying tension to the weft therebetween;

(c) means for rotating said post elements in opposite directions to any one of a plurality of predetermined positions for varying the forces with which said friction plates engage the weft including:

(i) a first control lever fixed on one end of one of said post elements;

(ii) a second control lever fixed intermediate its ends to one end of the other of said post elements having:

(a) an outer end defining an indicating arm for selectively rotating its respective post elements; and (d) means interconnecting said first and second control levers for effecting simultaneous rotative movement of said post elements during selective movement of said indicating arm.

2. The weft control device according to claim 1 wherein said interconnecting means includes:

(a) means defining an elongated opening adjacent the inner end of said second control lever; and (b) a depending tooth forming the end of said first control lever most remote from its respective post element and disposed within said elongated opening of said second control lever.

3. The weft control device according to claim 2 wherein said support means includes:

(a) guide means defining an arcuate slot adjacent one end thereof for limiting movement of said indicating arm;

(b) an arcuated band of indicating indicia operatively associated with one side of said guide means; and (c) means for locking said indicating arm in any selected position within the limits of said arcuated slot in correspondence with a selected graduation of said indicating indicia.

* * * * *